US005553701A

United States Patent [19]

Jarecki et al.

[11] Patent Number: 5,553,701

[45] Date of Patent: Sep. 10, 1996

[54] PAINT KIT INCLUDING SEALABLE TRAY ASSEMBLY

[75] Inventors: James J. Jarecki; Bruce C. Polzin, both of Greendale, Wis.

[73] Assignee: Newell Operating Company, Rockford, Ill.

[21] Appl. No.: 298,026

[22] Filed: Aug. 29, 1994

[51] Int. Cl.[6] ..... A45D 44/18; B05C 21/00

[52] U.S. Cl. ..... 206/15.2; 206/229; 220/306; 220/570; 401/118; 15/257.06

[58] Field of Search ..... 206/361, 15.2, 206/229, 209; 220/570, 306; 15/257.06; 401/118

[56] References Cited

U.S. PATENT DOCUMENTS

| | | | |
|---|---|---|---|
| 2,765,831 | 10/1956 | Tupper | 220/306 |
| 2,901,098 | 8/1959 | Tupper | 220/306 X |
| 3,032,927 | 5/1962 | Kobs | 220/306 X |
| 3,591,299 | 7/1971 | Pharris | 401/118 |
| 4,105,121 | 8/1978 | Mascetti | 220/306 X |
| 4,124,141 | 11/1978 | Armentrout et al. | 220/306 |
| 4,541,542 | 9/1985 | Florentino | 220/306 |
| 4,549,562 | 10/1985 | Ossi | 206/15.2 X |
| 4,560,082 | 12/1985 | Sutch | 220/306 X |
| 5,273,160 | 12/1993 | Malvasio | 220/570 X |
| 5,316,137 | 5/1994 | Kyllonen | 206/209 |

*Primary Examiner*—Bryon P. Gehman
*Attorney, Agent, or Firm*—Baker & McKenzie

[57] ABSTRACT

A paint tray assembly consisting of a paint tray and a separate cover which is attached to and removed from the tray by mating peripheral ribs on the underside of the lid and the top edge of the tray, and a paint kit composed of the tray assembly and a paint pad, the lid having a recess for receiving in loose, confining relationship a portion of the paint pad so that the paint kit can be suspended vertically or displayed horizontally with the paint pad always being retained in a relatively fixed relationship with the lid and tray.

10 Claims, 3 Drawing Sheets

63
46
44
12
65
64
53
55
61
57
60
56
47
48
50
10
24
39
71
41
42
40
11
14
22
32
15
16
18
69
70
37
25
23
19
13

45
47
48
49
12
46
44
31
32
33
35
13
30
29
34
28

24
47
71
23
25
13
12
14
60
70
61
69
56
50
52
46
17
16
19
68
16

PAINT KIT INCLUDING SEALABLE TRAY ASSEMBLY

BACKGROUND OF THE INVENTION

This invention relates to receptacles and kits, including a receptacle for paint and other coating material intended to be used during the application of paint or other coating. For the purpose of convenience of description the invention will be described in the context of paint application.

Paint applicators such as paint pads, paint rollers and paint brushes are widely available in retail outlets along with related accessories of which, with respect to at least pads and rollers, the most important is a tray for holding a batch of paint poured from a can or other container. In many retail outlets the paint pad or paint roller is sold separately from the paint tray and hence the consumer must make two selections, taking care to ensure that a proper size relationship between the applicator and the receptacle is purchased and, also, remembering that a receptacle must be purchased along with an applicator. In addition to the need to make the mental calculations and decisions that this implies, the retail customer must wait at the pay station while the purchased items are rung up separately and thereafter carry two parcels, or one containing the two odd sized loose products, away from the retail outlet.

The retail merchant who offers paint applicators and paint receptacles separately must keep track of and inventory two sku's, find valuable space, preferably side by side, for the display of two separate articles placed width by width, maintain two product display areas in a neat and orderly condition which will be pleasing to the eye of the consumer, run the risk of losing a sale because one of the two items is temporarily out of stock and, in general, accommodate the additional time and effort attributable to purveying multiple products, such as additional check-out time, etc. In addition, the retail merchant must supply a container, such as a bag, for the retail consumer to carry the purchased products away from the retail outlet, and the cost of said containers increases the merchant's total merchandising cost.

Paint kits consisting of a paint applicator and a tray have been developed and made available in an attempt to overcome the above described drawbacks associated with stocking, displaying and selling every product needed by the consumer as a separate item. Such kits have not been satisfactory however for several reasons. For example, few if any kits are so constructed that the paint applicator is maintained in a fixed, visually appealing position with respect to the tray when hung or supported on a display system in a variety of positions. Further, few if any kits currently available have the ability to withstand substantial shock loads such as are experienced when such a kit is dropped from a height of up to eight feet. And few if any kits currently available have the ability, in addition to the foregoing desirable characteristics, to function, in addition, as a package whereby a separate carrying container can be dispensed with.

There is accordingly a need for a paint tray assembly having a paint receptacle and a lid which provides a liquid tight, and virtually air tight, container when holding paint between active uses of the tray assembly and yet is easily assembled when the assembly is intended to function as a storage unit, and easily disassembled when the assembly is opened for active use. There is also a need for a paint kit consisting of at least a paint applicator and a tray assembly as above described which displays the applicator and the tray assembly in a visually appealing manner when presented to potential purchasers in a retail outlet and, at the same time is so rugged that it can withstand heavy shock loads such as are encountered when the kit is, for example, dropped on an edge from as high eight feet or even more, and which can function, in addition, as a carrying container.

SUMMARY OF THE INVENTION

The invention is a paint tray assembly consisting of a paint holding receptacle and a separate lid which eliminates costs and merchandising disadvantages for the retail merchant and, also, much effort and nuisance associated with the purchase of current such tray assemblies by the retail customer.

Specifically, the invention is directed to a paint tray assembly consisting of a receptacle and a separate cover, the cover being capable of being applied and removed from the receptacle as required.

For example, the cover may be applied to form a closed container for storage of paint during a period of time when the receptacle contains paint but is not in use, such as for night storage in the course of a job which cannot be completed in a single time period.

The invention is further specifically directed to a paint kit consisting of a tray assembly as above described and a paint applicator, such as a paint pad. The foregoing components are so arranged that the kit may be suspended from an elevated support such as a wire bracket extending outwardly from a support wall as commonly found in retail outlets, the components cooperating with one another in such a way that, assuming at least the tray cover is wholly or partially transparent, the paint applicator will be fixed in position with respect to the tray assembly. As a consequence the entire kit always presents a pleasing and organized appearance to the eye of a potential purchaser when suspended in any position from a support structure, including suspension from an elevated position.

In addition, the invention, whether presented in a simple tray assembly or kit form, is rugged without appearing massive, such ruggedness including the ability to withstand, without distortion or breakage, the shock of being dropped on an edge or corner from as high as eight feet. Other specific features and advantages will appear from an appreciation of the following description.

BRIEF DESCRIPTION OF THE DRAWING

The invention is illustrated more or less diagrammatically in the accompanying drawing wherein.

DESCRIPTION OF A SPECIFIC EMBODIMENT

Figure 1:
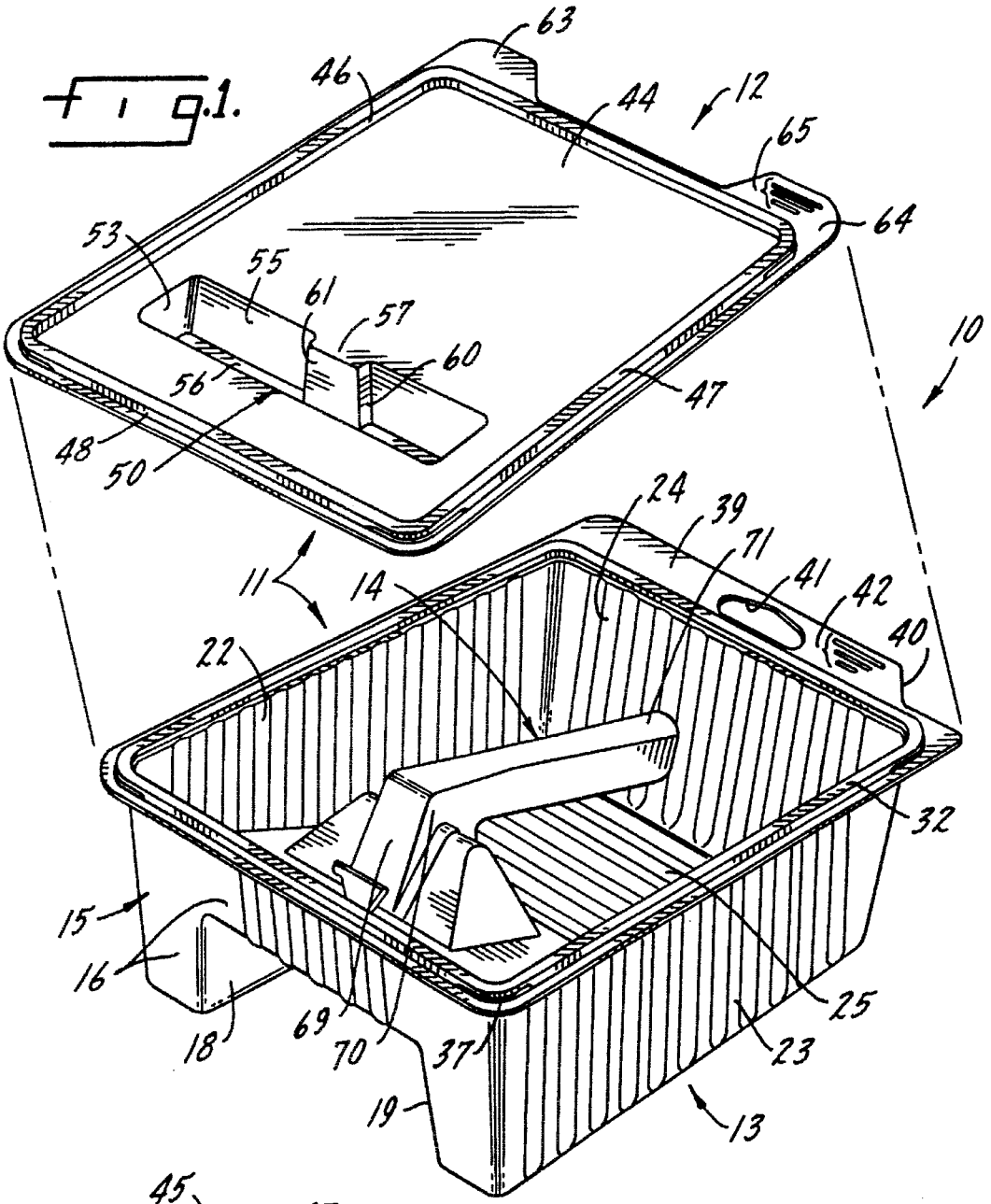
FIG. 1 is a perspective view of the paint kit of this invention, said paint kit including, as above described, a paint tray assembly consisting of a separate cover which is assemblable and disassemble from a paint tray.

In the following description of a specific embodiment like reference numerals will be used to refer to like or similar parts from Figure to Figure in the drawing.

Referring first to FIG. 1, the paint kit of this invention is illustrated generally at 10 in an exploded, disassembled condition. The paint kit 10 includes a tray assembly indicated generally at 11, the tray assembly consisting of a lid indicated generally at 12 and a paint tray indicated generally at 13. The kit 10, in addition to the tray assembly 11, also includes a paint applicator indicated generally at 14, here a paint pad.

Figure 5:
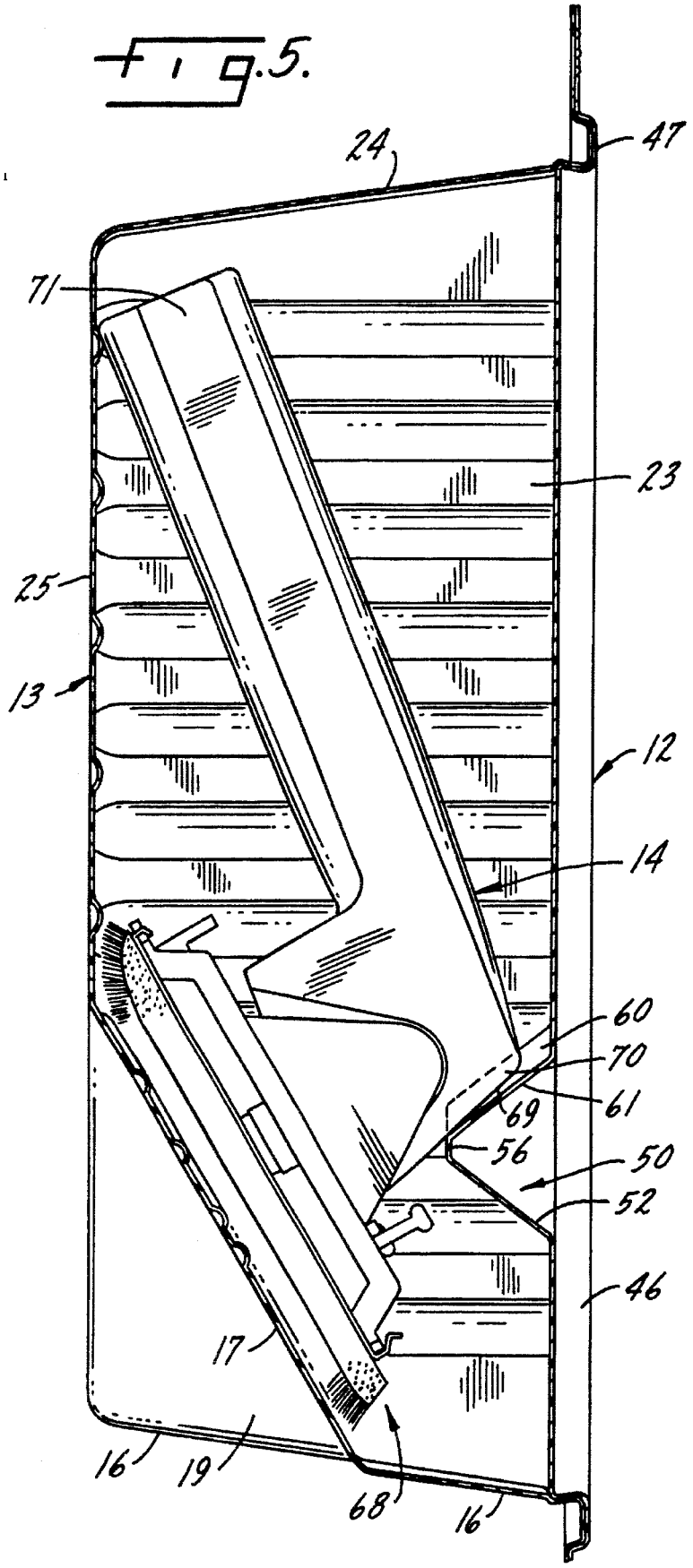
FIG. 5 is a section through the paint kit taken at a position which illustrates the paint pad in side elevation.

Paint tray 13 of tray assembly 11 includes a rear wall indicated generally at 15, the rear most portion 16 of said rear wall being formed generally in the shape of an inverted U as best seen in FIG. 1, and the balance of said rear wall 15 being formed from an inclined plane 17 and two generally triangularly shaped vertical panels 18, 19, see FIGS. 1 and 5, which connect the inclined plane 17 to the rear most portion 16. Left and right side walls 22, 23, respectively connect rear wall 15 to front wall 24. That portion of the bottom area defined by the front and side walls and not occupied by inclined wall 17 is indicated at 25.

Figure 2:
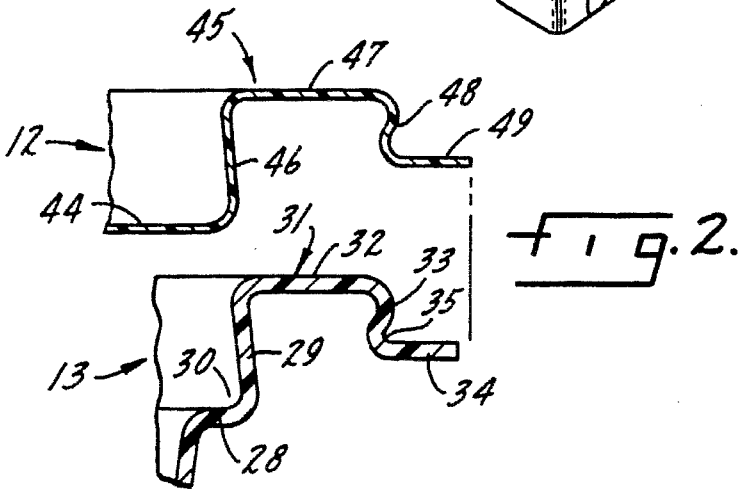
FIG. 2 is a detail view to an enlarged scale as viewed in FIG. 1 of the means for locking the lid to the paint tray in a normal, unstressed condition during assembly, disassembly, or when the tray assembly is in use.
Figure 4:
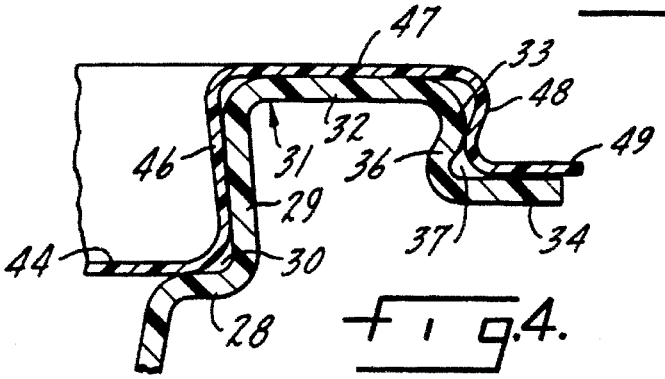
FIG. 4 is a view similar to, but to an enlarged scale as contrasted with, FIG. 2 showing the lid and paint tray in assembled condition with the locking means in an active, stressed condition.

The upper peripheral co-planar edges of rear wall 15, left and right side walls 22 and 23 and front wall 24, terminate in an outwardly projecting flange 28, see FIGS. 2 and 4, which smoothly blends into an inverted U shaped rib 31. Specifically, the flange 28 blends into a generally upwardly directed wall extension 29 which forms part of rib 31, the junction between flange 28 and extension 29 forming a seat 30, see FIG. 2, for the reception of a complementarily contoured portion of lid 12 as will appear in detail hereinafter. As seen in FIGS. 1, 2 and 4 the wall extension 29 is slightly inwardly directed using the center of the tray 13 as a reference point.

A second, larger outwardly extending co-planer peripheral flange is indicated at 32. A peripherally continuous downwardly and slightly inwardly inclined skirt is indicated at 33, see FIG. 2, the skirt 33 blending smoothly into the flange 32. The lower end of skirt 33 blends smoothly into an outermost, exposed flange or lip 34, and curved seat 35 is formed between skirt 33 and lip 34.

FIG. 2 illustrates the skirt 33, lip 34 and seat 35 at the corners in an exploded relationship. Skirt 33 is slanted inwardly in a downward direction to a greater extent at the four corners over approximately the ninety degrees of turn at each corner, as indicated at 36 in FIG. 4, to form a seat or undercut 37 in the quadrant area of each of the four corners, than along the sides.

From FIG. 1 it will be noted that the lip 34 extends horizontally outwardly a substantially greater distance along the front wall 24 to form a grasping flange 39 except at the right front corner where it is cut away at 40. A hanger cutout 41 is formed in the center of the grasping flange 39 to enable the tray assembly and/or the paint kit to be suspended from a hook or suspension extending outwardly from a vertical support surface. Three finger purchase ridges 42 project upwardly from the top surface of flange 39 to assist the user in, primarily, separating the lid from the tray.

Lid 12 includes a flat portion 44 which surrounds a trough indicated generally at 50 near the rear end of the tray assembly. The peripheral edge of flat portion 44 terminates in an inverted U-shaped rib 45, see FIG. 2, which includes an upwardly and inwardly extending wall 46 whose inward angle of inclination is the same or substantially the same as the inward angle of inclination of wall extension 29 of the tray, see FIG. 2, and, particularly, FIG. 4. The lower edge of lid wall 46 blends smoothly into the flat portion 44 of the lid. The upper end of lid wall 46 blends smoothly into a horizontal co-planer flange 47 which in turn blends smoothly into downwardly and slightly inwardly extending lid skirt 48. The lower end of lid skirt 48 blends smoothly into lid edge flange 49 which extends peripherally outwardly a slightly greater distance from the center of the tray assembly than does tray flange 34 as best seen in FIGS. 2 and 4. As will be noted from FIG. 2, 4 and 5 U-shaped rib 45 is dimensioned to slip over and come to rest secured to the peripheral tray rib 31 at the upper edges of walls 15, 22, 23 and 24, see FIG. 4 particularly. Two extensions 63, 64 are formed at the left and right corners of lid flange 49 at the front of the lid. Three finger purchase ridges 65 are formed on right front lid extension 64 to assist the user in separating the lid from the tray.

The trough 50 is formed by downwardly and inwardly inclined rear wall 52, left and right downwardly and inwardly inclined side walls 53, 54, respectively, and a front wall indicated generally at 55. A bottom wall is indicated at 56. Front wall 55 has formed therein a projection 57, see FIG. 1, looking in a rearward direction, said projection 57 having narrow left and right side walls 59, 60, respectively, and rear wall 61 said rear wall 61 forming an abutment which mechanically blocks movement of paint applicator 14 in a rearward direction as next described.

Figure 3:
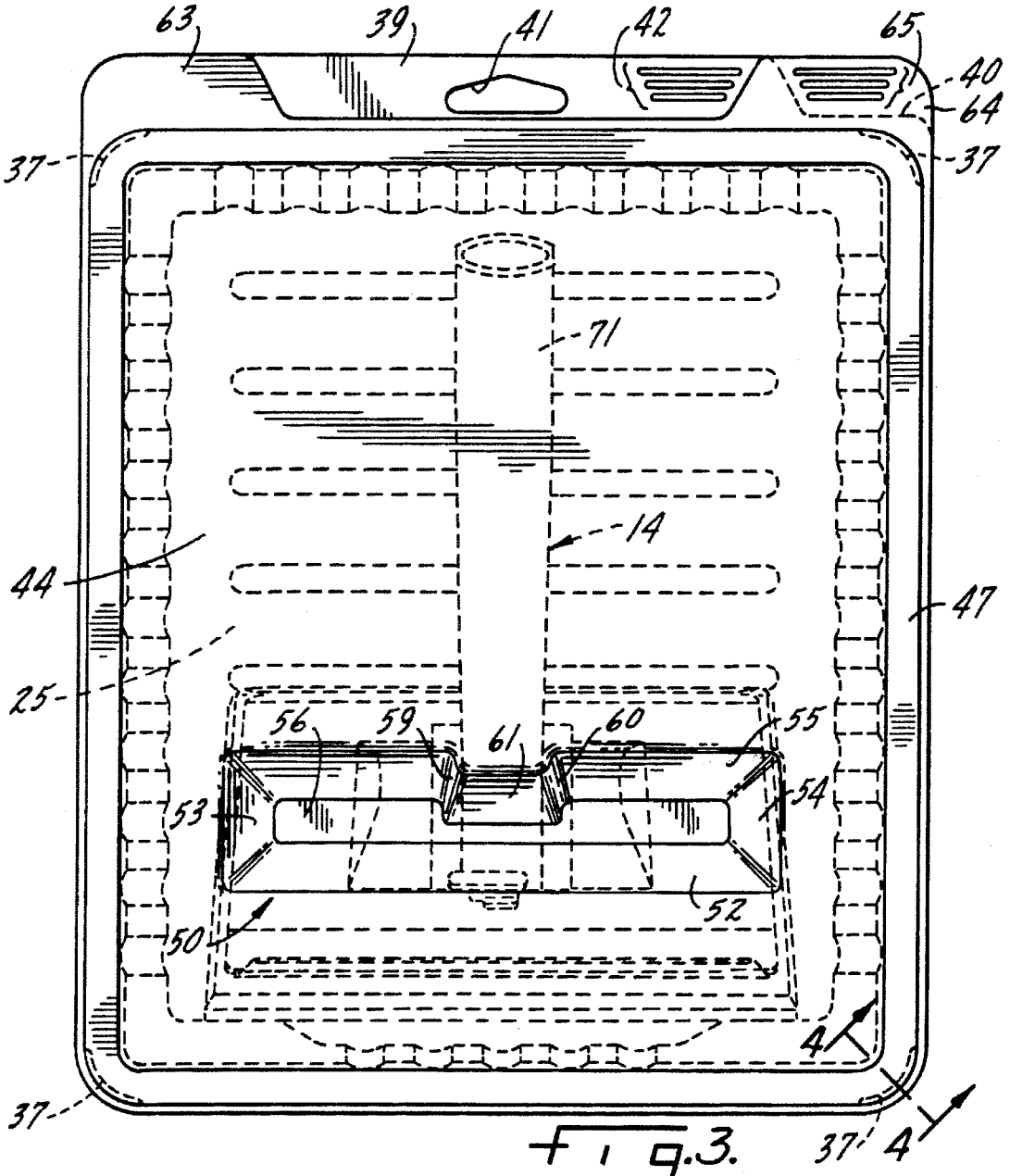
FIG. 3 is a top plan view of the paint kit in an assembled condition showing the interior features of the paint tray and a paint pad in phantom.

As best seen in FIGS. 1 and 3 paint applicator 14 is dimensioned to be entirely received within the cavity formed in tray 13 with the pad portion, indicated generally at 68, of the paint pad resting on the surface of the inclined plane 17. The nose portion of the paint pad, indicated generally at 69, see FIG. 1, is so dimensioned that when the pad portion 68 of paint pad 14 rests on inclined plane 17, the upper side edges 70 of the nose portion 69 of the paint pad overlap the left and right side walls 59 and 60 of front wall projection 57, see FIGS. 1 and 3. Rear wall 61 of projection 57 acts as a stationary abutment to block movement of the paint pad 14 in a downward direction as viewed in FIG. 5. The length of the handle 71 with respect to the distance between front wall 24 and projection 57, and the angle of inclined plane 17 relative to the contour of the paint pad, is so dimensioned that the paint pad is locked into the position of FIG. 5, with only slight variation, in all angular orientations of the paint kit with respect to the vertical; i.e., from the vertical position of FIG. 5 to a position ninety degrees tilted with respect thereto and all angles there between. Thus, whether the paint kit is displayed for purchase in the vertical position of FIG. 5 or in a horizontal position ninety degrees removed from the FIG. 5 position, the paint applicator will retain its same relative position with respect to the paint tray assembly, and hence an orderly, eye pleasing appearance of the paint kit will always be presented to the retail customer. It will be understood of course that the width of nose portion 69 of the applicator 14 will be slightly less than the inside dimension of the two walls 59, 60 which form the sides of projection 57 for ease in assembly during manufacturing. Such slight clearance is not sufficient however to permit the applicator 14 to become skewed with respect to the paint tray assembly so that the orderly appearance of the paint kit is maintained at all times.

It will be noted that when the lid 12 is assembled to the tray 13 the relatively thin material of which the lid 12 is formed, as contrasted to the thicker material of the tray 13, results in the lid 12, and particularly lid skirt 48, being deflected outwardly to pass the obstruction formed by tray skirt 33. The contour of the peripheral rib 31 of the tray is such however that after the lid skirt 48 passes the tray skirt 33 in a downward direction, the lid skirt is not able to return to its unstressed condition illustrated in FIG. 2; rather, the tray rib 45 remains in tension whereby the lid is held to the tray in a tight, grasping relationship which is substantially sealed throughout the entire peripheral area or line of contact between the tray and the lid. The increased undercut areas in the four quadrant areas 37 are so dimensioned as to increase the grasping effect.

It should be noted that the undercut quadrant areas 37 need not be located solely in the corners; they may be present along the wall sides as well. However the undercuts at the corner are particularly effective in forming a locking relationship between the tray and the lid. In fact, tests have established that when a paint kit formed of PET with a tray thickness of about 0.030 inches and a lid thickness of about 0.015 inches holding a paint pad formed from conventional material, such as HD polyethylene having a nominal wall thickness of about 0.75, is dropped on a corner from a height of eight feet onto a hard surface, the lid will not separate from the tray. Such a shock load is greater than any shock load which would normally be encountered in the manufacturing, shipping, displaying and selling of such a paint kit, including dropping of the paint kit by a customer in a retail store.

It should also be noted that the lid and tray have separate utility in the absence of the paint applicators. Thus, since a good seal is formed between the lid and tray as above described by the tension connection existing between the peripheral rib 31 of the tray and the lid rib 45, the two parts function as a sealed container for holding paint between uses of the paint kit. Thus, should the user not be able to complete a project and be forced to terminate work before the paint stored in tray 13 is used, the lid 12 may be snapped onto the tray 13 and the paint left over night or longer without danger of solvent evaporation and the consequent formation of a skin on the paint. The applicator would of course be stored separately, as in a solvent or under water.

Thus there has been disclosed a paint tray and accompanying lid which has utility in the absence of an applicator and a paint kit consisting of a lid, tray and applicator which, when assembled, presents a neat compact eye pleasing appearance in all positions of display and, at the same time, is resistant to breakage or separation resulting from all shock loads which are normally encountered in the manufacture, shipping, displaying and selling of a paint kit as above described.

Although a specific embodiment of the invention has been illustrated and described it will be appreciated from the foregoing description that modifications may be made without departing from the spirit and scope of the invention. Accordingly it is intended that the scope of the invention be limited solely by the scope of the hereafter appended claims when interpreted in light of the relevant prior art, and not by limitations set out in the foregoing specification.

We claim:

1. In a paint tray assembly, a lid having an upper surface and a lower surface, and a tray, said tray having a continuous peripheral rib about its upper periphery, said lid having a continuous, peripheral rib about its periphery, said lid defining a covering portion therewithin, no portion of said covering portion extending above said peripheral rib, said lid rib having a contour which is complementary to the tray rib contour whereby the tray lid may be received in the lid rib, the inner width dimension of the lid rib being slightly less than the outer width dimension of the tray rib, said lid and tray rib being formed from a flexible material having the flexure and memory characteristics of plastic, whereby, when said lid rib is brought into engagement with said tray rib the lid rib flexes with respect to the tray rib and, upon engagement, remains in tension in a deformed condition to thereby lock said rib to said tray in a sealing relationship, said lid having applicator abutment means extending downwardly from the lower surface of the lid and into the tray when said lid is assembled to said tray, said applicator abutment means being located to block movement of an applicator having a handle contained within the assembled lid and tray in a direction parallel to the axis of the handle.

2. The paint tray assembly of claim 1 further characterized in that the contours of the tray rib and the lid rib are constant except at several vertically aligned locations.

3. The paint tray assembly of claim 2 further characterized in that the lid and tray each have a generally rectangular configuration, and the vertically aligned locations include the four corners of the generally rectangular tray assembly.

4. In a paint kit, a paint applicator, a paint tray, and a paint lid, said paint applicator being of a size and configuration to be received within the paint tray when said lid is assembled to said tray to form a three-part kit, said applicator and said lid having positioning means cooperable with one another when the kit is in an assembled condition, said positioning means including abutment means carried by the lid and abutment means carried by the applicator which mechanically cooperate to block any relative movement between the paint applicator and the paint tray, when the paint applicator, the paint tray and the paint lid are assembled into a kit to thereby maintain the applicator in generally the same relative position with respect to the paint tray in all relative positions of the kit to the horizontal.

5. The paint kit of claim 4 further characterized in that the applicator is a conventional paint pad carried by a handle.

6. The paint kit of claim 4 further characterized in that the mechanical abutment means carried by the lid is disposed beneath the upper surface of the periphery of the lid and projects, when assembled to the tray, downwardly to a point beneath the upper surface of the periphery of the tray.

7. In a paint kit, a paint applicator a paint tray having side walls and ends, and a paint lid having an upper surface and a lower surface, said paint applicator being of a size and configuration to be received within the paint tray when said lid is assembled to said tray to form a three-part kit, said applicator and said lid having positioning means cooperable with one another when the kit is in an assembled condition which maintains the applicator in generally the same relative position with respect to the paint tray in all relative positions of the kit to the horizontal, said applicator being a conventional paint pad carried by a handle, said lid positioning means including a recess in the lid located above the pad area of the paint pad when the lid, tray and pad are assembled, said recess being located in front of and generally aligned with the front surface of a support structure of the pad beneath the lower surface of the lid whereby motion of the pad in a direction toward the recess is precluded in all relative positions of the lid to the horizontal, said recess further having associated therewith a pair of generally vertically disposed members which extend downwardly from the lower surface of the lid and flank a portion of the pad support structure, whereby motion of the pad in a direction toward either side wall of the tray is precluded in all relative positions of the kit to the horizontal.

8. The paint kit of claim 7 further characterized in that the paint tray includes an inclined surface at one end thereof, the recess in the lid, when the kit is assembled, being at the same end of the kit as the inclined surface of the tray, said inclined surface further precluding movement of the paint pad toward the inclined surface, the distance between the inclined surface and the opposite end of the paint tray being such that movement of a paint pad to a position in which the downwardly extending member in the recess no longer flanks a portion of the pad support structure is precluded.

9. The paint kit of claim 8 further characterized in that the recess in the paint lid is a trough which is located generally perpendicularly to the long dimension of the paint pad when the paint pad is assembled in the paint kit, and the generally vertically disposed members extend downwardly from the lid on the side walls of a projection in the wall of the trough most remote from the inclined plane of the tray.

10. The paint kit of claim 9 further characterized in that the thickness of the material forming the lid rib is less than the thickness of the material forming the tray rib.

* * * * *